US005685145A

United States Patent [19]

Sung et al.

[11] Patent Number: 5,685,145

[45] Date of Patent: Nov. 11, 1997

[54] METHOD AND APPARATUS FOR PERFORMANCE ENHANCEMENT OF THE MANIFOLD CATALYST IN THE AUTOMOTIVE EXHAUST SYSTEM

[75] Inventors: Shiang Sung, New York, N.Y.; Dennis R. Anderson, Plainsboro; Harold N. Rabinowitz, Upper Montclair, both of N.J.

[73] Assignee: Engelhard Corporation, Iselin, N.J.

[21] Appl. No.: 384,974

[22] Filed: Feb. 7, 1995

[51] Int. Cl.[6] ..... F01N 3/28

[52] U.S. Cl. ..... 60/284; 60/289; 60/297

[58] Field of Search ..... 60/297, 298, 274, 60/289, 284

[56] References Cited

U.S. PATENT DOCUMENTS

| | | | |
|---|---|---|---|
| 3,828,552 | 8/1974 | Nishiguchi | 60/282 |
| 3,910,042 | 10/1975 | Yuge | 60/298 |
| 5,271,906 | 12/1993 | Yuuki | 60/297 |
| 5,373,696 | 12/1994 | Adamczyk | 60/289 |

FOREIGN PATENT DOCUMENTS

| | | | |
|---|---|---|---|
| 6066133 | 3/1994 | Japan | 60/297 |
| 1359660 | 7/1974 | United Kingdom | 60/298 |

*Primary Examiner*—Douglas Hart
*Attorney, Agent, or Firm*—Richard A. Negin

[57] ABSTRACT

In an exhaust gas system comprising a hydrocarbon trap (28) and a downstream catalyst zone (30), a heat exchange catalyst member (10) is incorporated into the system to provide heat exchange between the exhaust gas and air that is pumped through the heat exchange catalyst member (10). The heated air is injected into the exhaust gas stream to facilitate the oxidation of hydrocarbons in the downstream catalyst zone. The heat exchange catalyst member (10) defines two separate flow paths therethrough, one of the flow paths containing a catalyst zone for the exhaust gas. In an alternative embodiment, the injected air is heated by a heat exchange trap (28') or by a separate heating element (62).

16 Claims, 5 Drawing Sheets

METHOD AND APPARATUS FOR PERFORMANCE ENHANCEMENT OF THE MANIFOLD CATALYST IN THE AUTOMOTIVE EXHAUST SYSTEM

BACKGROUND OF THE INVENTION

1. Field of the Invention

This invention relates to the reduction of noxious automotive emissions, and more particularly to an exhaust treatment apparatus comprising an adsorbent hydrocarbon trap and a catalyst composition downstream of the trap.

In order to meet Governmental emissions standards for internal combustion engine exhaust, motor vehicle manufacturers emplace so-called catalytic converters in the exhaust gas lines of their vehicles. A common form of converter comprises a catalyst member which comprises a honeycomb monolith having gas flow passages extending therethrough. The monolith carries a coating of catalytically active material which is effective to convert noxious components of the exhaust gas, which may include unburned hydrocarbons, carbon monoxide and $NO_x$, to innocuous substances, e.g., to carbon dioxide, $H_2O$ and nitrogen. A common type of catalytic material is a so-called three-way catalyst, which typically comprises catalytically effective amounts of platinum and/or palladium and rhodium dispersed on a refractory inorganic oxide support material such as alumina by methods well-known to those skilled in the art. Three-way catalysts are known for their ability to substantially simultaneously oxidize unburned hydrocarbons and carbon monoxide to $CO_2$ and $H_2O$ while reducing $NO_x$ to nitrogen and oxygen. U.S. Pat. No. 4,171,287 to Keith, dated Oct. 16, 1979, and U.S. Pat. No. 4,678,770 to Wan et al, dated Jul. 7, 1989, disclose several three-way catalyst compositions and methods of preparing them, and both are hereby incorporated herein by reference. Oxidation catalyst may be prepared in the same manner without the inclusion of a rhodium component.

Oxidation catalysts and three-way catalysts are generally not effective until they have been heated to a threshold temperature often identified as the "light-off" temperature. Ordinarily, during the operation of an automotive engine, the exhaust gases heat the catalytic converter to the light-off temperature within a few minutes of operation. However, during those initial minutes of operation known as the "cold-start" period, the exhaust system apparatus is cold, so the exhaust gases transfer the heat they contain to heat the catalytic converter and other components of the exhaust system. During the cold-start period, the exhaust gases are rich in hydrocarbons which pass through the cold catalytic converter substantially unaffected. Recently, efforts have been made to reduce cold-start emissions, including incorporating an adsorbent hydrocarbon trap in the exhaust gas line. Such traps allow the exhaust gases to flow in contact with an adsorbent material, e.g., a molecular sieve, which adsorbs and thus retains hydrocarbons during the cold-start period. When the adsorbent is heated to its desorption temperature, it exhibits a net desorption of hydrocarbons. A catalyst member capable of oxidizing hydrocarbons, including desorbed hydrocarbons, is conventionally disposed downstream of the trap.

2. Related Art

In SAE Paper 930739, Hochmuth et al disclose in FIG. 8 a number of exhaust configurations in which a hydrocarbon trap is disposed between catalyst zones defined by discrete catalytic converters or passes of a heat exchange crossflow monolith having three-way catalyst material in both passes.

The Paper describes the addition of air into the exhaust gas stream to burn desorbed hydrocarbons, including the injection of air at a point downstream from the hydrocarbon trap to assist in the combustion of desorbed hydrocarbons in a catalyst zone further downstream from the trap.

U.S. Pat. No. 5,147,417 to Nemser, dated Sep. 15, 1992, discloses an air intake device for an automobile. The device comprises a canister that houses a selectively permeable membrane comprising an amorphous polymer of perfluoro-2,2-dimethyl-1,3-dioxole having a thickness preferably less than 0.01 mm and exhibiting an oxygen/nitrogen selectivity of at least 1.4:1. The polymer may be a homopolymer or a copolymer also comprising, e.g., tetrafluoroethylene, perfluoromethylvinyl ether, vinylidene fluoride and chlorotrifluoroethylene. The amorphous polymer preferbly has a glass transition temperature of at least 140° C. Air is flowed into the canister to produce an oxygen-rich portion and an oxygen-poor portion, and the oxygen-rich portion is provided to the engine to facilitate the combustion of fuel.

U.S. Pat. No. 5,158,753 to Take et al, dated Oct. 27, 1992, discloses an exhaust treatment apparatus for an internal combustion engine, comprising a crossflow heat exchanger, a hydrocarbon trap and at least one catalyst zone. The hydrocarbon trap is placed between passes of the heat exchanger, so that heat in the exhaust gases is transferred from the first zone of the heat exchanger to the second zone. Accordingly, gases leaving the first zone are cooler than they otherwise would be upon entering the hydrocarbon trap. After flowing through the trap the gases flow into the second zone of the heat exchanger where they reclaim the heat previously transferred. At a point downstream of the second heat exchanger zone, the exhaust gas flows through a catalyst zone. In the embodiment of FIG. 2, the second pass of the heat exchanger comprises the catalyst material.

SUMMARY OF THE INVENTION

The present invention relates broadly to an exhaust gas treatment apparatus for converting at least hydrocarbons in an exhaust gas stream of an engine to innocuous substances. The apparatus defines a flow path for the exhaust gas and comprises trap means in the flow path for adsorbing hydrocarbons in the exhaust gas stream at least during a cold-start period of engine operation, and for desorbing the hydrocarbons in a subsequent period of engine operation. A downstream catalyst zone is disposed in the flow path downstream from the trap means, and comprises a catalytic material effective at least for conversion of hydrocarbons to innocuous substances. There is an air injection means for injecting air into the exhaust gas stream to facilitate the conversion of hydrocarbons in the downstream catalyst zone, and air heating means for heating the air before the air is injected into the exhaust gas stream.

According to one aspect of the present invention, the exhaust gas treatment apparatus may comprise an upstream catalyst zone disposed in the exhaust gas flow path upstream from the trap means. The upstream catalyst zone comprises a catalytic material effective for the conversion of at least one of carbon monoxide, hydrocarbons and nitrogen oxides to innocuous substances, and the apparatus may comprise heat exchange means for transferring heat from the exhaust gas to the injected air before the air is injected into the exhaust gas stream.

According to another aspect of the invention the heat exchange means may comprise a heat exchanger comprising first and second gas flow zones disposed in mutual heat exchange relation with each other wherein the first gas flow zone comprises a part of the flow path. Optionally, the first gas flow zone may comprise one of the upstream catalyst zone and the trap means.

According to still another aspect of the invention, the air injection means may comprise a gas separation means for separating environmental air into an oxygen-rich portion and an oxygen-poor portion, and the air injection means may inject the oxygen-rich portion into the exhaust gas stream.

Several other aspects of the invention provide, for example, that the apparatus may further comprise sensor means for sensing one of (a) the duration of cold-start engine operation, and (b) fuel-rich engine operation, and the air injection means may function to inject the air into the exhaust gas stream during at least one of a cold-start period and fuel-rich engine operation. Also, there may be catalyst heating means for heating the catalytic material in the downstream catalyst zone to its light-off temperature.

In a particular embodiment, the sensor means may sense the temperature of the exhaust gas entering the trap means, and the air injection means may be responsive to the sensor means for flowing the air through the second gas flow zone and injecting the air into the exhaust gas stream when the exhaust gas entering the trap means attains a predetermined temperature. The air injection means may be dimensioned and configured to inject air into the exhaust gas stream at a point upstream of the upstream catalyst zone, or at a point downstream of the trap means, or both.

In an alternative embodiment, the invention may comprise an exhaust gas treatment apparatus for converting at least hydrocarbons in an exhaust gas stream to innocuous substances. The apparatus defines a flow path for the exhaust gas and comprises air heating means comprising a heat exchange catalyst member. The heat exchange catalyst member comprises a first gas flow zone and a second gas flow zone. The first gas flow zone comprises part of the flow path for the exhaust gas and comprises a catalytic material effective for the conversion of at least some pollutants in the exhaust gas stream to innocuous substances. In the second gas flow zone, a gas, e.g., air, may be disposed in heat exchange relation with the exhaust gas in the first gas flow zone. This embodiment of the invention further comprises a downstream catalyst zone disposed in the flow path downstream from the first gas flow zone of the heat exchange catalyst member. The downstream catalyst zone comprises a catalytic material effective at least for the conversion of hydrocarbons in the exhaust gas to innocuous substances. There is also an air injection means for flowing air through the second gas flow zone in the heat exchange catalyst member and then injecting the air into the flow path at a point upstream of the downstream catalyst zone. The heat exchange catalyst member may comprise a manifold catalyst member.

The invention also provides a method for treating an exhaust gas stream comprising noxious components at least comprising carbon monoxide and hydrocarbons, by flowing the gas stream through an exhaust system as described above. More specifically, the method comprises heating an oxygen-containing gas, intermixing the heated oxygen-containing gas with the exhaust gas stream to produce an exhaust gas/oxygen mixture, and flowing the exhaust gas/oxygen mixture into contact with a catalyst composition effective at least for the conversion of hydrocarbons to innocuous substances.

In another aspect, the invention provides a method for treating an exhaust gas stream comprising (a) transferring heat from the exhaust gas stream to air; (b injecting at least a portion of the heated air to the exhaust gas stream to produce an air-exhaust mixture; and (c) flowing the air-exhaust mixture into contact with a downstream catalyst composition effective at least for the oxidation of hydrocarbons and carbon monoxide to innocuous substances.

Optionally, the method may further comprise the step of (d) flowing the exhaust gas stream into contact with a hydrocarbon trap to adsorb hydrocarbons onto the trap from the exhaust gas stream, which may be performed after step (a) and before step (b). Optionally, the method may also comprise, before step (a), the step of (e) flowing the exhaust gas into contact with an upstream catalyst composition effective to convert at least some of the noxious components thereof to innocuous substances. Step (e) may comprise flowing the exhaust gas through a heat exchange catalyst member comprising a first gas flow zone comprising the upstream catalyst composition, and a second gas flow zone in heat exchange relation with the first gas flow zone. Transferring heat from the exhaust gas stream to the air may comprise flowing the air through the second gas flow zone while the exhaust gas flows through the first gas flow zone. Alternatively, step (d) may comprise flowing the exhaust gas through a trap member comprising a first gas flow zone and a second gas flow zone in mutual heat exchange relation with each other, the first gas flow zone comprising the trap means, and wherein step (a) comprises flowing the air through the second gas flow zone while the exhaust gas flows through the first gas flow zone.

In a particular embodiment the method may further comprise monitoring the temperature of the exhaust gas contacting the hydrocarbon trap and initiating the flow of air in heat exchange relation with the exhaust gas when the temperature of the exhaust gas reaches a predetermined temperature. The method may optionally further comprise producing an oxygen-rich portion of heated environmental air and injecting the oxygen-rich portion into the exhaust gas stream.

DETAILED DESCRIPTION OF THE INVENTION AND PREFERRED EMBODIMENTS THEREOF

The present invention provides an improved exhaust system for an internal combustion engine by injecting oxygen, or another oxygen-containing gas such as air, into the exhaust gas stream to facilitate the oxidation of hydrocarbons in the exhaust gas stream to innocuous substances, e.g., $CO_2$ and $H_2O$. In one aspect, an apparatus according to the present invention comprises air heating means to heat the air before it is injected into the exhaust gas stream, and thus improves the conversion performance of the catalyst composition used to treat hydrocarbons in the exhaust gas stream.

In another aspect, an exhaust treatment apparatus according to the present invention employs a heat exchanger to transfer heat from the exhaust gas to the air to be injected into the exhaust gas stream. The heat is drawn from the exhaust gas to postpone the desorption of hydrocarbons from the trap, and the heated air is intermixed with the exhaust gas to facilitate the oxidation of hydrocarbons in the exhaust gas in a catalyst zone downstream from the trap. Optionally, the heat exchanger may comprise a heat exchange catalyst member that defines two gas flow zones, one of which comprises the upstream catalyst zone. Hot exhaust gas is flowed through the first gas flow zone, i.e., the upstream catalyst zone, which comprises a catalytic material effective for the conversion of at least one of nitrogen oxides, hydrocarbons and carbon monoxide to innocuous substances, and air is flowed through the second gas flow zone. In this way, heat is transferred from the hot exhaust gas to the air. After being heated in the crossflow monolith, the air is injected into the exhaust gas stream. Environmental air may be chosen as a convenient and inexpensive source of oxygen, but it will be understood by those skilled in the art that gaseous oxygen may be injected into the exhaust gas stream in other forms. For economy of expression, the term "air", as used herein and in the claims to refer to a gas being injected into the exhaust gas stream, is meant to encompass not only environmental air but also any other oxygen-containing gas, including pure oxygen, that may promote the oxidation of hydrocarbons and carbon monoxide in the exhaust gas stream.

In some embodiments, the invention provides means for deriving from ambient air an oxygen-rich portion and means for injecting the oxygen-rich portion into the exhaust gas stream while diverting the remaining oxygen-poor portion for use elsewhere in the vehicle.

Figure 1A:
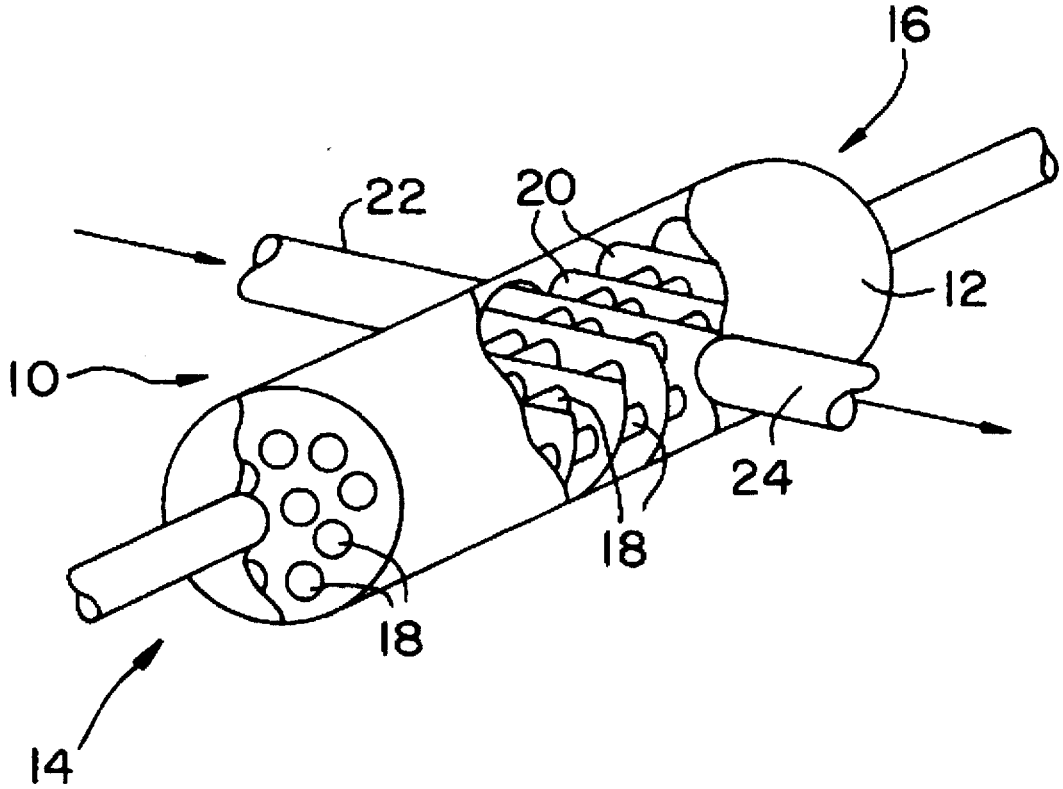
FIG. 1A is a partly broken-away perspective view of a heat exchange catalyst member for use in an apparatus according to the present invention.

As shown in FIG. 1A, a heat exchange catalyst member 10 for use in an exhaust system in accordance with the present invention comprises a canister 12 having an exhaust gas inlet 14 and an exhaust gas outlet 16. A plurality of gas flow tubes 18 extend between exhaust gas inlet 14 and exhaust gas outlet 16 to define a first gas flow zone through canister 12. The interior walls of tubes 18 are coated with catalytic material effective for the conversion of at least one of nitrogen oxides, carbon monoxide and hydrocarbons to innocuous substances. Exhaust gas inlet 14 and exhaust gas outlet 16 define manifolds that guide exhaust gases into and out from tubes 18.

Figure 1B:
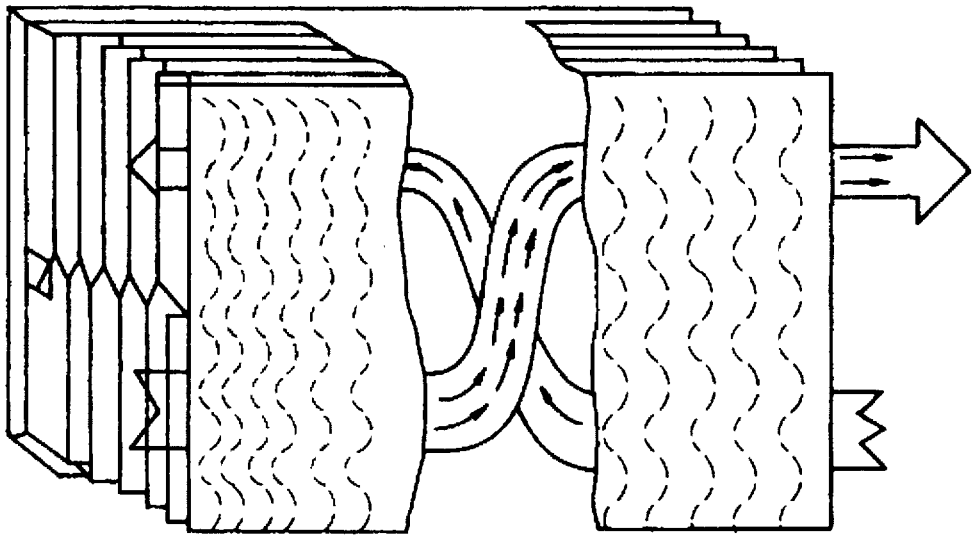
FIG. 1B is a partly broken-away view of an alternative heat exchange catalyst member for use in an apparatus according to the present invention.

Within canister 12, a plurality of heat exchange fins 20 are mounted on the exterior of tubes 18. Canister 12 is also equipped with an air inlet 22 and an air outlet 24 by which air (i.e., any oxygen-containing gas) can be introduced into canister 12 as a heat exchange fluid, e.g., as a coolant, to flow around tubes 18 and in contact with heat exchange fins 20. Thus, air introduced into canister 12 can be heated by hot exhaust gas flowing through tubes 18 and the hot exhaust gas is, accordingly, cooled without intermixing the air and the exhaust gas. The path of cooling air through canister 12 constitutes a second gas flow zone through the canister. A heat exchanger of this type is available from Modine Manufacturing Company under the designation MODINE BT UNIT™. An alternative, preferred configuration for a heat exchange catalyst member has a counter-flow configuration, as shown in FIG. 1B. A device of this type is commercially available from United Air Specialists, Inc. under the trade designation TEMP-X-CHANGER™.

Figure 2A:
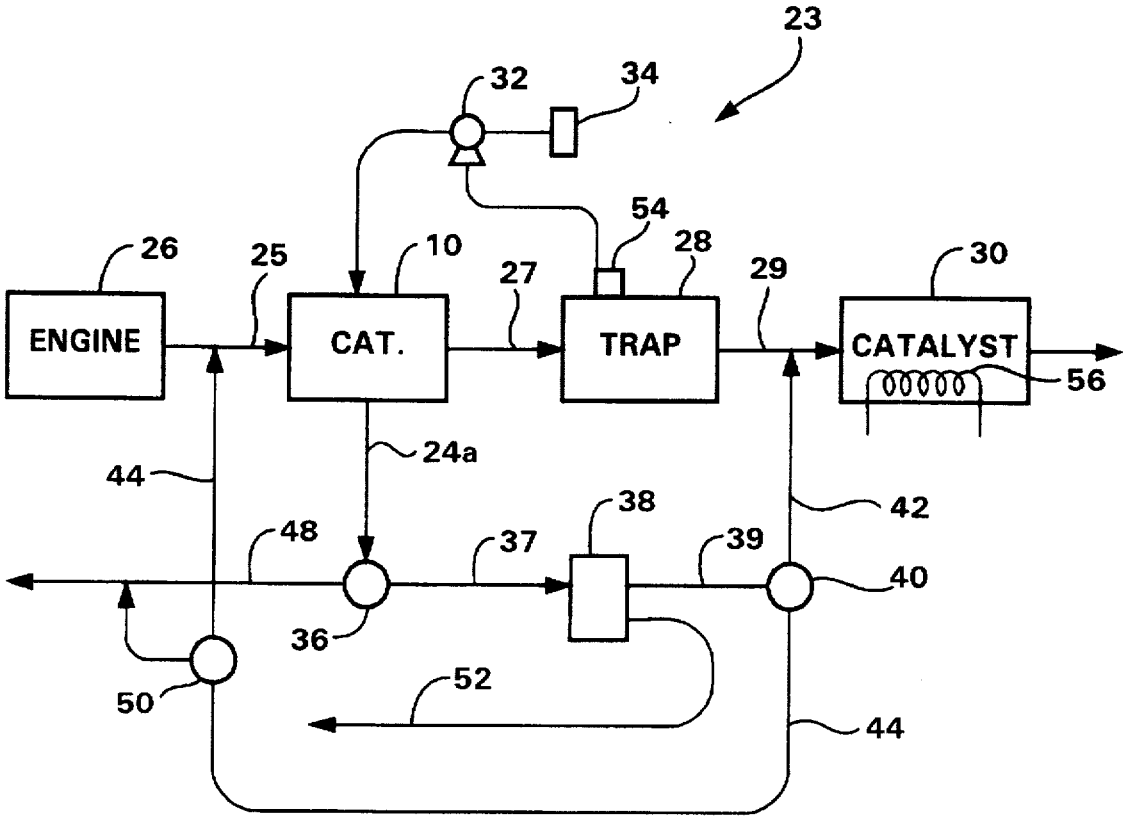
FIG. 2A is a schematic diagram of an exhaust apparatus in accordance with one embodiment of the present invention.

An exhaust gas treatment apparatus in accordance with another embodiment of the present invention is shown in FIG. 2A. Apparatus 23 defines a flow path for the exhaust gases from engine 26, the flow path extending from engine 26 through conduit 25 to an upstream (relative to trap 28) catalyst zone provided by heat exchange catalyst member 10, and from heat exchange catalyst member 10 through conduit 27 to a hydrocarbon trap 28, which comprises an adsorbent material effective for adsorbing hydrocarbons at least during a cold-start period of engine operation. The flow path continues from trap 28 through conduit 29 to a downstream (relative to trap 28) catalyst zone 30, which comprises a catalyst composition effective at least for the conversion of hydrocarbons, including hydrocarbons desorbed from trap 28, to innocuous substances.

Air pump 32 draws air through an optional air filter 34 and pumps the air through the second gas flow zone of heat exchange catalyst member 10. The heated air, or a portion thereof, is flowed through an air injection path which comprises air outlet conduit **24*a*, which is connected to the air outlet of heat exchange catalyst member 10 and which leads to an optional first differential valve 36, from which the heated air flows through conduit 37 to an optional oxygen-enrichment filter 38. Filter 38 may be used when air or another oxygen-containing mixture of gases is used as a source of oxygen to be injected into the exhaust gas stream, and is similar in construction to the air intake device of U.S. Pat. No. 5,147,417 discussed above. Filter 38 serves to divide the heated air into an oxygen-rich portion that may comprise, e.g., up to about 60 percent oxygen, and an oxygen-poor portion. The oxygen-rich effluent of filter 38 flows through conduit 39 to an optional second differential valve 40 and then to injection line 42, which injects the heated oxygen-containing gas into the exhaust gas stream, thus completing the air injection path and facilitating the conversion of hydrocarbons desorbed from trap 28. The heated air or oxygen-containing gas may be injected into the exhaust gas stream at any desired point. For example, injection line 42 injects the oxygen-containing gas into the exhaust gas stream at a point downstream of trap 28. An alternative injection line 44, which incorporates valve 50, may provide injection of the heated oxygen-containing gas into the exhaust gas stream at a point upstream of trap 28 and, in the illustrated embodiment, upstream of heat exchange catalyst member 10. As a result, the oxygen and the exhaust gas are intermixed to produce an exhaust gas/oxygen mixture, which flows in contact with downstream catalyst zone 30** to convert at least hydrocarbons and optionally other noxious components, into innocuous substances.

In operation, exhaust gas leaves engine 26 and flows into the catalyst zone in the first gas flow zone of heat exchange catalyst member 10, then through trap 28 and then downstream to catalyst zone 30. During the cold-start period of engine operation, a significant portion of the hydrocarbons in the exhaust gas are adsorbed by trap 28. As the temperature of the exhaust gas rises, it warms trap 28 towards its desorption temperature. Meanwhile, air pump 32 pumps air through the second gas flow zone of catalyst member 10. The air, being cool relative to the exhaust gases, absorbs heat from the exhaust gases and thus slows the temperature rise in trap 28. Assuming that heat exchange catalyst member 10 has a counter-flow configuration and achieves 80 percent heat exchange efficiency, exhaust gas flowing at 2000 liters per minute at an inlet temperature of 600° C. can be cooled in heat exchange catalyst member 10 by cooling air flowing at 700 liters per minute at an inlet temperature of 25° C., and the exhaust gas leaving heat exchange catalyst member 10 will be at about 140° C., while the air will be at about 485° C. Similarly, exhaust gas flowing at 3000 liters per minute with an inlet temperature of 750° C. and being cooled by cooling air flowing at 900 liters per minute at an inlet temperature of 25° C. will be cooled to about 170° C., whereas the air will be heated to about 605° C.

The heated air is returned through the air injection path (air outlet conduit 24*a*, conduit 37, optional filter 38, and injection line 42) into the exhaust gas stream. In the illustrated embodiment, first differential valve 36 flows at least a major portion of the heated air to oxygen-enrichment filter 38, which serves to divide the air into an oxygen-rich portion and an oxygen-poor portion. The oxygen-rich portion of the gas leaving oxygen-enrichment filter 38 flows through second differential flow valve 40, which guides at least a major portion of the oxygen-rich gas into one or both of downstream injection line 42 and alternative injection line 44, to inject the heated oxygen-rich gas into the exhaust gas stream.

Optionally, first differential valve 36 may divert a minor portion of the heated air to the fuel injection system of the engine through secondary air line 48 to improve engine efficiency in the combustion of fuel. Similarly, a differential valve 50 may be incorporated into injection line 44 to divert some of the oxygen-rich gas into secondary air line 48, for use by the engine. Preferably, heated oxygen-containing gas is directed to the engine inlet at least during periods of acceleration. The heated oxygen-poor gas produced by filter 38 may be flowed through a heating line 52 to heat, e.g., the fuel tank of a vehicle.

Optionally, any one or more of valves 36, 40 and 50 may operate in response to sensors that indicate particular operating conditions of the engine or of the components of the exhaust gas apparatus, as may the air injection means. Thus, a trap temperature sensor 54 may comprise, for example, a thermocouple disposed in the exhaust apparatus at a point where it indicates the temperature of exhaust gas entering trap 28, e.g., on trap 28 or at the inlet thereof. Air pump 32 may be connected to sensor 54, and may be programmed to commence pumping air into the exhaust gas stream when sensor 54 indicates that the exhaust gas is at or near a predetermined temperature, preferably the desorption temperature. For example, sensor 54 may initiate pump 32 when it senses a temperature of about 140° C., which is generally reached in the underfloor position about 40 seconds after start-up for a typical vehicle under FTP conditions. Alternatively, or in addition, air pump 32 may be responsive to a timer that activates air pump 32 for an interval following engine start-up corresponding to a typical cold-start period of engine operation, e.g., the first 120 seconds of the FTP cold-start test described at 40 CFR, part 86, sections 115–178. (Accordingly, as used herein and in the claims, the term "sensor" is meant to encompass a timer.) The air pump 32 might also be responsive to a sensor that indicates when the engine is operating under fuel-rich condition, e.g., during acceleration, by monitoring the revolutions per minute (RPMs) of the engine. During acceleration and other fuel-rich operation modes, when the exhaust gas produced by the engine contains higher-than-normal quantities of hydrocarbons, it is advantageous for air pump 32 to supply extra oxygen to exhaust gas for treatment in the downstream catalyst zone, regardless of whether trap 28 is desorbing hydrocarbons.

Downstream catalyst zone 30 may be equipped with heating means to accelerate the activity of the catalyst material therein, thus improving the catalyst performance in the conversion of hydrocarbons in the exhaust gas stream. For example, catalyst zone 30 may comprise an electric heating element 56. Heating element 56 may be controlled by a timer or thermocouple disposed in catalyst zone 30 or in the exhaust gas stream. Heating element 56 heats the downstream catalyst zone 30 during a period of engine operation to accelerate the heating of the catalyst material therein to its light-off temperature. The light-off temperature is generally about 300° C.

The present invention provides several advantages over the prior art. For example, the withdrawal of heat from the exhaust gases at a point upstream of trap 28 allows the use of a wider range of adsorbent materials in trap 28, since the trap is not exposed to temperatures as high as they otherwise would be. Also, the injection of air into the exhaust gas stream, which facilitates the oxidation of hydrocarbons, allows for the use of less catalytic material in catalyst zone 30.

Optionally, air pump 32 can be used to flow cooling air through heat exchange catalyst member 10 even during periods when no hydrocarbons are being desorbed, to cool the catalyst composition in heat exchange catalyst member 10 and thus prevent catalyst degradation due to exposure to excessive temperatures. Accordingly, the preliminary catalyst zone can be incorporated further upstream in the flow path, i.e., closer to the engine, than a conventional upstream catalyst zone. Thus, heat exchange catalyst member 10 can be placed near, or in, the exhaust manifold, and will remain active in these positions for longer periods of time than conventional upstream catalyst members due to the protective cooling effect produced by air pump 32. The invention thus provides an improvement in the use of manifold catalysts, which offer the advantage of being quickly heated to their light-off temperature due to their proximity to the engine, but which are subject to premature deactivation due to overheating.

Figure 2B:
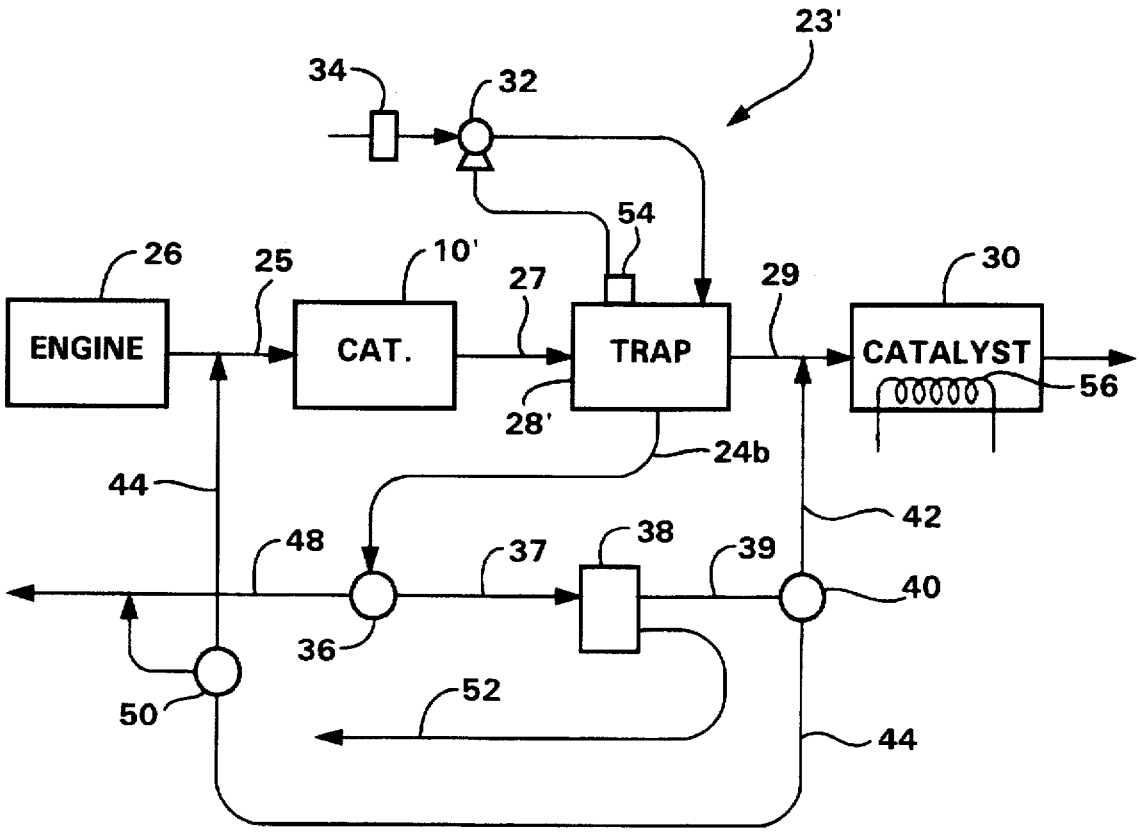
FIG. 2B is a schematic diagram of an exhaust apparatus in accordance with a second embodiment of the present invention.

In an another embodiment of an exhaust apparatus in accordance with the present invention, the air heating means of the apparatus 23' shown in FIG. 2B comprises a heat exchange trap member 28' rather than the heat exchange catalyst member 10 of FIG. 2A. In FIG. 2B, catalyst zone 10' comprises a conventional single flow zone catalyst member, while trap member 28' comprises a first gas flow zone which comprises an adsorbent material and through which the exhaust gas flows and a second gas flow zone through which air is flowed by pump 32. The heated air leaving trap 28 can be utilized in the same manner as heated air from heat exchange catalyst member 10 of FIG. 2A, as indicated in FIG. 2B by the connection of air outlet conduit 24*b* to pump 36. The remainder of apparatus 23' is identical to apparatus 23 of FIG. 2A, and can be understood by reference to FIG. 2A and the associated text.

Figure 2C:
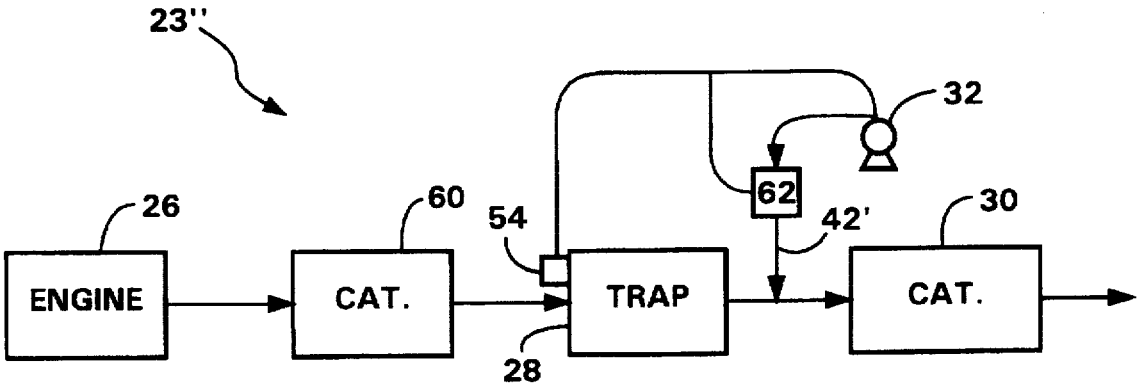
FIG. 2C is a schematic view of another embodiment of an apparatus in accordance with a third embodiment of the present invention.

FIG. 2C shows another, simpler apparatus 23" in accordance with the present invention, used in connection with engine 26. Apparatus 23" comprises an optional upstream catalyst member 60 which comprises a three-way catalyst, trap 28 disposed downstream of upstream catalyst 60 and downstream catalyst member 30 disposed downstream from trap 28. Air pump 32 pumps air through an independently powered catalyst heating element 62, and air injection line 42' flows air from catalyst heating element 62 into the exhaust gas stream. Catalyst heating element 62 may comprise, for example, electric heating coils powered from the battery of the automobile. In use, trap 28 adsorbs hydrocarbons from the exhaust gas stream at least during the cold-start period of engine operation. When sensor 54 senses that the temperature of the exhaust gases is at, or near, the desorption temperature of trap 28, it sends a signal to air pump 32 and catalyst heating element 62. Air pump 32 then pumps air through catalyst heating element 62, where the air is heated, and the air is then injected through injection line 42' into the exhaust gas stream. Introducing hot air into the exhaust gas stream helps raise the temperature of the exhaust gas stream to facilitate catalytic conversion of hydrocarbons in the exhaust gas stream by catalyst zone 30, including hydrocarbons desorbed by trap 28, while providing oxygen to combust the desorbed hydrocarbons. Alternatively, pump 32 and heating element 62 may be responsive to other sensors, e.g., a timer or an engine speed sensor, as discussed above with respect to the embodiment of FIG. 2A.

Figure 2D:
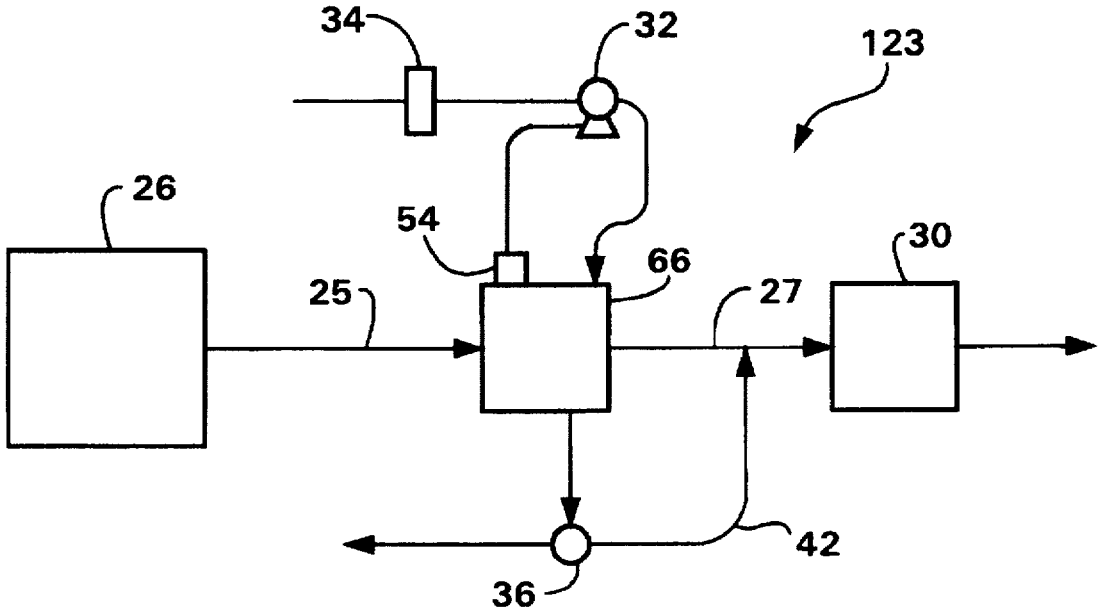
FIG. 2D is a schematic view of an apparatus in accordance with a fourth embodiment of the present invention.

Still another embodiment of an exhaust gas treatment apparatus in accordance with the present invention is shown in FIG. 2D. In apparatus 123, the air heating means comprises a heat exchange catalyst member 66 comprising first and second gas flow zones in mutual heat exchange relation with each other. The first gas flow zone is part of the exhaust gas flow path and comprises a catalytic material effective for the abatement of at least some pollutants, e.g., hydrocarbons, in the exhaust gas. Air, optionally filtered by filter 34, is flowed by pump 32 through conduit **32*a* and then through the second gas flow zone of member 66. The air is thus flowed in heat exchange with hot exhaust gases flowed to member 66 from engine 26, via conduit 25. After the heated air leaves the second gas flow zone of member 66, it flows through a differential valve 36 and then conduit 42 from which it is injected into the exhaust gas stream flowing through conduit 27. The mixture of heated air and exhaust gas flows through a downstream catalyst zone 30, which comprises a catalytic material effective at least for the conversion of hydrocarbons to innocuous substances. Pump 32 may be responsive to a temperature sensor 54 at member 66 so that air is flowed through member 66 when a predetermined temperature is attained. Preferably, air is flowed through member 66** to help prevent the catalytic material in the first gas flow zone from being overheated.

The ability to draw heat from the catalyst member makes feasible the placement of catalyst member 66 in a position close to the engine, e.g., at the exhaust manifold, which is an advantageous location since the proximity to the engine reduces the time required for the catalyst to reach its light-off temperature. In a conventional exhaust apparatus, the high temperature of the exhaust gas flowing through a manifold catalyst member leads quickly to catalyst deactivation. By providing air heating means that withdraws heat from the manifold catalyst member, the useful life of the manifold catalyst member is substantially prolonged.

While the invention has been described in detail with reference to particular embodiments thereof, and while some features may have been shown in own embodiment and not the others, it will be apparent that upon a reading and understanding of the foregoing, numerous alterations to the described embodiments will occur to those skilled in the art and it is intended to include such alterations within the scope of the appended claims.

What is claimed is:

1. An exhaust gas treatment apparatus for converting at least hydrocarbons in an exhaust gas stream of an engine to innocuous substances, the apparatus defining a flow path for the exhaust gas stream and comprising:

trap means in the flow path for adsorbing hydrocarbons in the exhaust gas stream at least during a cold-start period of engine operation and for desorbing the hydrocarbons in a subsequent period of engine operation;

a downstream catalyst zone disposed in the flow path downstream from the trap means, and comprising a catalytic material effective at least for conversion of hydrocarbons to innocuous substances;

air injection means for injecting air into the exhaust gas stream at a location downstream of the trap and upstream of the downstream catalyst to facilitate the conversion of hydrocarbons in the downstream catalyst zone; and air heating means for heating the air before the air is injected into the exhaust gas stream.

2. An exhaust gas treatment apparatus for converting at least hydrocarbons in an exhaust gas stream of an engine to innocuous substances, the apparatus defining a flow path for the exhaust gas stream and comprising:

a trap means in a first gas flow zone of the flow path for adsorbing hydrocarbons in the exhaust gas stream at least during a cold-start period of engine operation and for desorbing the hydrocarbons in a subsequent period of engine operation;

a downstream catalyst zone disposed in the flow path downstream from the trap means, and comprising a catalytic material effective at least for conversion of hydrocarbons to innocuous substances;

air injection means for injecting air into the exhaust gas stream to facilitate the conversion of hydrocarbons in the downstream catalyst zone; and air heating means for heating the air before the air is injected into the exhaust gas stream, the air heating means comprising a heat exchanger comprising the first gas flow zone and a second gas flow zone disposed in mutual heat exchange relation with each other, and wherein the first gas flow zone comprises a part of the flow path, for transferring heat from the exhaust gas to the air before the air is injected into the exhaust gas stream.

3. An exhaust gas treatment apparatus for converting at least hydrocarbons in an exhaust gas stream of an engine to innocuous substances, the apparatus defining a flow path for the exhaust gas stream and comprising:

trap means in the flow path for adsorbing hydrocarbons in the exhaust gas stream at least during a cold-start period of engine operation and for desorbing the hydrocarbons in a subsequent period of engine operation;

a downstream catalyst zone disposed in the flow path downstream from the trap means, and comprising a catalytic material effective at least for conversion of hydrocarbons to innocuous substances;

an upstream catalyst zone disposed in the flow path upstream of the trap means, the upstream catalyst zone comprising a catalytic material effective for the conversion of at least one of carbon monoxide, hydrocarbons, and nitrogen oxides to innocuous substances;

air injection means for injecting air into the exhaust gas stream to facilitate the conversion of hydrocarbons in the downstream catalyst zone, wherein the air injection means is dimensioned and configured to inject air into the exhaust gas stream at a point upstream of the upstream catalyst zone; and air heating means for heating the air before the air is injected into the exhaust gas stream.

4. The apparatus of claim 1, 2 or 3 further comprising catalyst heating means for heating the catalytic material of the downstream catalyst zone to its light-off temperature.

5. The apparatus of claim 1 wherein the air heating means comprises a heat exchanger comprising first and second gas flow zones disposed in mutual heat exchange relation with each other, and wherein the first gas flow zone comprises a part of the path, for transferring heat from the exhaust gas to the air before the air is injected into the exhaust gas stream.

6. The apparatus of claim 5 wherein the first gas flow zone comprised the trap means.

7. The apparatus of claim 1 or 2 further comprising an upstream catalyst zone disposed in the flow path upstream of the trap means, the upstream catalyst zone comprising a catalytic material effective for the conversion of at least one of carbon monoxide, hydrocarbons, and nitrogen oxides to innocuous substances.

8. The apparatus of claim 7 wherein the air injection means is dimensioned and configured to inject air into the exhaust gas stream at a point upstream of the upstream catalyst zone.

9. The apparatus of claim 3 wherein the heat exchange means comprises a heat exchanger comprising first and second gas flow zones disposed in mutual heat exchange relation with each other, and wherein the first gas flow zone of the heat exchanger comprises the upstream catalyst zone.

10. The apparatus of claim 1, claim 5, claim 9, claim 2 or claim 3 wherein the air injection means comprises a gas separation means for separating environmental air into an oxygen-rich portion, and wherein the air injection means injects the oxygen-rich portion into the exhaust gas stream.

11. The apparatus of claim 1, claim 5, claim 2 or claim 3 further comprising sensor means for sensing one of (a) the duration of cold-start engine operation, and (b) fuel-rich engine operation; wherein the air injection means functions to inject the air into the exhaust gas stream during at least one of a cold-start period and fuel-rich engine operation.

12. The apparatus of claim 1, claim 5, claim 9, claim 2 or claim 3 further comprising sensor means for sensing the temperature of the exhaust gas entering the trap means, wherein the air injection means is responsive to the sensor means for flowing the air through the second gas flow zone and injecting the air into the exhaust gas stream when the exhaust gas entering the trap means attains a predetermined temperature.

13. The apparatus of claim 1, claim 5, claim 9, claim 2 or claim 3 wherein the air injection means is dimensioned and configured to inject air into the exhaust gas stream at a point downstream of the trap means.

14. The apparatus of claim 1, claim 5, claim 9, claim 2 or claim 3 further comprising catalyst heating means for heating the secondary catalytic material of the downstream catalyst zone to its light-off temperature.

15. An exhaust gas treatment apparatus for converting at least hydrocarbons in an exhaust gas stream of an engine to innocuous substances, the apparatus defining a flow path for the exhaust gas stream and comprising:

air heating means comprising a heat exchange catalyst member comprising a first flow gas zone and a second gas flow zone, the first gas flow zone comprising a catalytic material effective for the conversion of at least some pollutants in the exhaust gas stream to innocuous substances, the first gas flow zone comprising part of the flow path, and a second gas flow zone for disposing a gas in heat exchange relation with exhaust gas in the first gas flow zone;

a downstream catalyst zone disposed in the flow path downstream from the first gas flow zone and comprising a catalyst effective at least for the conversion of hydrocarbons in the exhaust gas stream to innocuous substances; and air injection means, for flowing air through the second gas flow zone of the heat exchange catalyst member and for injecting the air into the flow path at a point upstream of the first gas flow zone.

16. The apparatus of claim 15 wherein the heat exchange catalyst member comprises a manifold catalyst member.

* * * * *